US009409735B2

(12) United States Patent
Abe et al.

(10) Patent No.: US 9,409,735 B2
(45) Date of Patent: Aug. 9, 2016

(54) SHEET PROCESSING APPARATUS AND IMAGE FORMING APPARATUS

(71) Applicant: CANON KABUSHIKI KAISHA, Tokyo (JP)

(72) Inventors: Hideto Abe, Toride (JP); Rikiya Takemasa, Kashiwa (JP); Masaya Takahashi, Kofu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/445,450

(22) Filed: Jul. 29, 2014

(65) Prior Publication Data

US 2015/0042032 A1 Feb. 12, 2015

(30) Foreign Application Priority Data

Aug. 6, 2013 (JP) ..... 2013-162893

(51) Int. Cl.

| | |
|---|---|
| ***B65H 31/34*** | (2006.01) |
| ***B65H 5/02*** | (2006.01) |
| ***B65H 3/04*** | (2006.01) |
| ***B65H 31/36*** | (2006.01) |

(52) U.S. Cl.

CPC ..... *B65H 5/026* (2013.01); *B65H 3/045* (2013.01); *B65H 3/047* (2013.01); *B65H 31/36* (2013.01); *B65H 2402/31* (2013.01); *B65H 2403/42* (2013.01); *B65H 2404/265* (2013.01); *B65H 2801/27* (2013.01)

(58) Field of Classification Search

CPC ..... B65H 31/34; B65H 31/36; B65H 2404/2682; B65H 5/026; B65H 2404/265; B65H 2404/2693; B65H 3/047; B65H 3/04

See application file for complete search history.

(56) References Cited

U.S. PATENT DOCUMENTS

| | | | | |
|---|---|---|---|---|
| 6,220,592 | B1 * | 4/2001 | Watanabe | B65H 31/36 270/58.12 |
| 6,352,253 | B1 * | 3/2002 | Hayakawa | B65H 9/06 270/58.12 |
| 6,377,777 | B1 | 4/2002 | Kishino et al. | |
| 6,459,878 | B1 | 10/2002 | Tomoyuki et al. | |
| 6,601,846 | B2 * | 8/2003 | Saito | B65H 37/04 270/58.12 |

(Continued)

FOREIGN PATENT DOCUMENTS

| | | | |
|---|---|---|---|
| CN | 101948052 | A | 1/2011 |
| DE | 60123702 | T2 | 8/2007 |

(Continued)

OTHER PUBLICATIONS

European Search Report issued in corresponding European Application No. 14179625.0 dated Dec. 10, 2014.

(Continued)

*Primary Examiner* — Jeremy R Severson

(74) *Attorney, Agent, or Firm* — Fitzpatrick, Cella, Harper & Scinto

(57) ABSTRACT

A sheet processing apparatus includes an endless belt configured to convey the sheet by coming in contact with an upper surface of the sheet stacked on the sheet stacking portion, a shaft extending in a direction orthogonal to the sheet conveying direction, and a supporting portion rotatably supporting the drive rotating member and supporting the endless belt through the drive rotating member. The supporting portion is configured to be swingable about the shaft and the endless belt is raised and lowered by the supporting portion being swung by a lifting portion.

21 Claims, 13 Drawing Sheets

(56) References Cited

U.S. PATENT DOCUMENTS

| | | | | |
|---|---|---|---|---|
| 6,862,424 | B2 | 3/2005 | Matsunaka et al. | |
| 6,865,362 | B2 | 3/2005 | Otsuka et al. | |
| 7,461,837 | B2 * | 12/2008 | Saito | B42C 1/12 270/58.07 |
| 7,533,883 | B2 * | 5/2009 | Moeller | 271/220 |
| 7,578,497 | B2 * | 8/2009 | Kawata et al. | 270/37 |
| 7,725,068 | B2 | 5/2010 | Matsunaka et al. | |
| 7,866,649 | B2 * | 1/2011 | Saito | B42C 1/12 270/58.08 |
| 7,991,341 | B2 | 8/2011 | Matsunaka et al. | |
| 8,226,080 | B2 * | 7/2012 | Morita | B65H 31/3027 270/58.04 |
| 8,454,010 | B2 * | 6/2013 | Saito et al. | 271/221 |
| 8,777,211 | B2 * | 7/2014 | Lo | 271/34 |
| 2002/0008350 | A1 | 1/2002 | Adachi et al. | |
| 2006/0113726 | A1 | 6/2006 | Moeller | |
| 2008/0277857 | A1 | 11/2008 | Kawata et al. | |
| 2010/0283198 | A1 * | 11/2010 | Saito | B42C 1/12 271/221 |
| 2011/0006476 | A1 | 1/2011 | Morita et al. | |

FOREIGN PATENT DOCUMENTS

| | | | |
|---|---|---|---|
| EP | 1160099 | A2 | 12/2001 |
| EP | 1160099 | A3 | 12/2001 |
| EP | 1160099 | B1 | 10/2006 |
| JP | 01-242360 | A | 9/1989 |
| JP | 2001-335227 | A | 12/2001 |
| JP | 2003-128315 | A | 5/2003 |
| JP | 3728178 | B2 | 12/2005 |
| TW | 201404607 | A | 1/2014 |

OTHER PUBLICATIONS

Chinese Office Action issued in corresponding Chinese Patent Application No. 20140382227.7 dated Mar. 8, 2016.

* cited by examiner

SHEET PROCESSING APPARATUS AND IMAGE FORMING APPARATUS

BACKGROUND OF THE INVENTION

1. Field of the Invention

This disclosure relates to a sheet processing apparatus and an image forming apparatus.

2. Description of the Related Art

In the related art, an image forming apparatus such as a copier, a printer, a facsimile, and a multi-function printer includes a type provided with a sheet processing apparatus in a main body of the image forming apparatus and configured to perform processing such as binding or the like on sheets discharged from the main body of the image forming apparatus. Example of the sheet processing apparatus as described above includes a type configured to discharge a sheet discharged from the main body of the image forming apparatus once into a process tray, align the sheet with a sheet already stacked on the process tray, bind the sheets if needed in the process tray, and then discharge the processed sheets on a stacking tray as described in Japanese Patent Laid-Open No. 2003-128315.

FIGS. 13A and 13B are drawings illustrating a configuration of the sheet processing apparatus of the related art as described above. As illustrated in FIGS. 13A and 13B, a trailing end stopper 108 configured to stop and position the sheet(s) P is provided at an end of an intermediate processing tray 107. The sheet P discharged onto the intermediate processing tray 107 by a sheet discharge roller 103 is conveyed by an endless knurled belt 1161 configured to be rotated by the sheet discharge roller 103, and aligned at trailing ends thereof by abutting against the trailing end stopper 108.

The shape of the knurled belt 1161 is changed by an moving roller X.

That is, as illustrated in FIG. 13A, if there is no sheet bundle on the intermediate processing tray 107, the moving roller X does not move. In this case, the knurled belt 1161 is not deformed and rotates in a state of being in contact with the intermediate processing tray 107. In contrast, when a plurality of sheets P are stacked on the intermediate processing tray, the moving roller X moves to deform the shape of the knurled belt 1161 as illustrated in FIG. 13B, so that a pressure as constant as possible is applied from the knurled belt 1161 to a sheet bundle PA.

In the sheet processing apparatus of the related art as described above, when the knurled belt 1161 is deformed, the distance between the sheet discharge roller 103 and the moving roller X changes. Therefore, tensile force of the knurled belt 1161 is increased in comparison with the case where the number of stacked sheets is small.

When the tensile force is increased, a conveying force of the knurled belt 1161 increases correspondingly. When the conveying force is increased, the sheet P in abutment with the trailing end stopper 108 may be bent between the knurled belt 1161 and the trailing end stopper 108 and, consequently, alignment of the sheet may be impaired.

As a countermeasure, a method of controlling the amount of movement of the moving roller X by considering a change in tensile force of the knurled belt 1161 is conceivable. However, if the hardness of the knurled belt 1161 is changed by a change in atmospheric temperature or time degradation, a deviation occurs between the amount of movement of the moving roller X and the conveying force. This deviation is increased with increase in amount of movement. Accordingly, when an actual conveying force is smaller than a desired conveying force, the sheet P does not reach the trailing end stopper 108. In contrast, when the actual conveying force is larger than the desired conveying force, the sheet P is bent between the knurled belt 1161 and the trailing end stopper 108 and, consequently, alignment is impaired.

SUMMARY OF THE INVENTION

According an aspect of the present invention, a sheet processing apparatus including a sheet stacking portion on which a sheet is stacked, an endless belt configured to convey the sheet by coming in contact with an upper surface of the sheet stacked on the sheet stacking portion, an aligning portion against which the sheet conveyed by the endless belt is abutted and aligning a position in a sheet conveying direction of the sheet, a drive rotating member configured to contact with an inner peripheral surface of the endless belt, a shaft extending in a direction orthogonal to the sheet conveying direction, a supporting portion configured to be swingable about the shaft, rotatably supporting the drive rotating member, and supporting the endless belt through the drive rotating member, and a lifting portion configured to raise and lower the endless belt by swinging the supporting portion.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
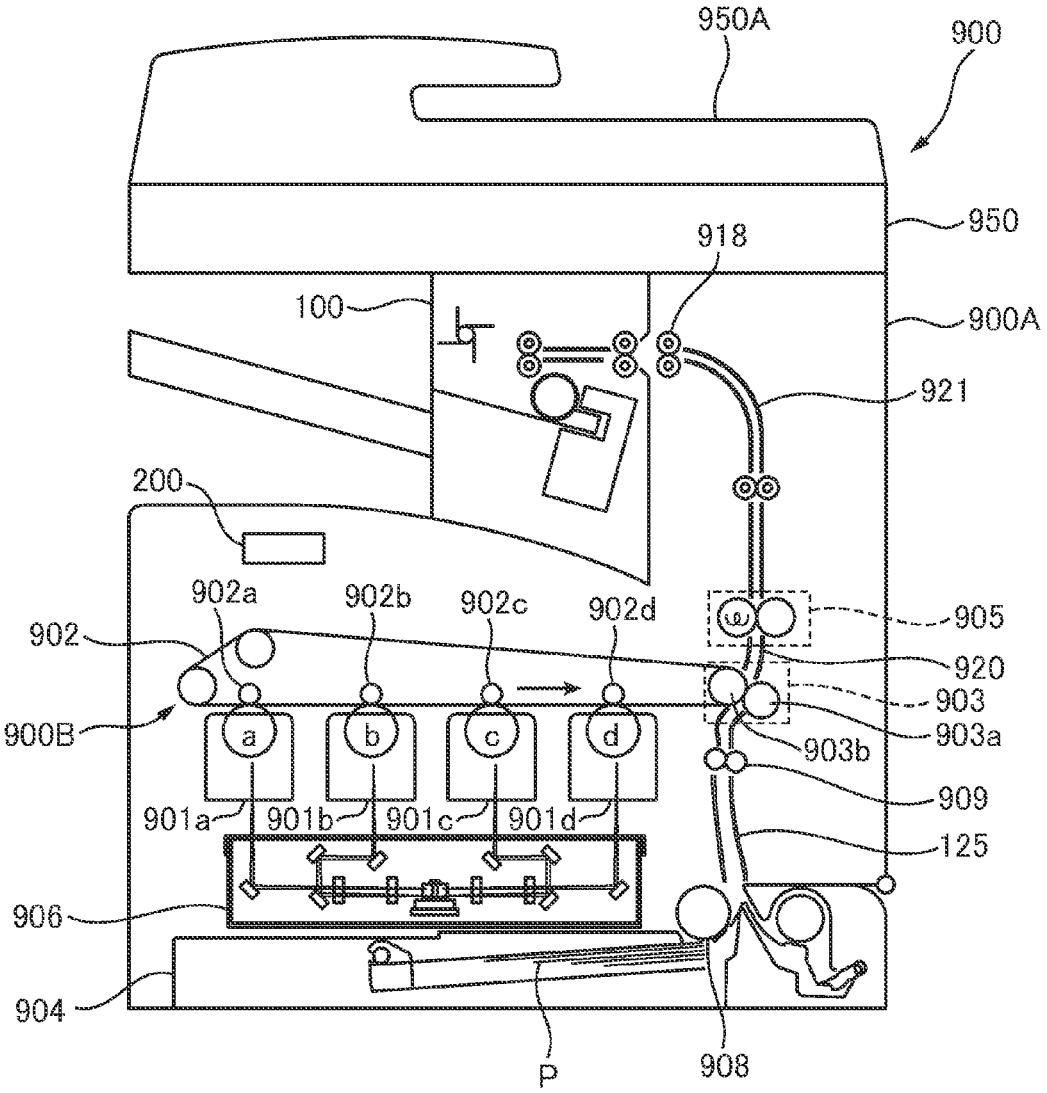
FIG. 1 is a drawing illustrating a configuration of an image forming apparatus provided with a sheet processing apparatus of a first embodiment.

Hereinafter, embodiments of the present invention will be described in detail with reference to the drawings. FIG. 1 is a drawing illustrating a configuration of an image forming apparatus provided with a sheet processing apparatus of a first embodiment. In FIG. 1, reference numeral 900 denotes an image forming apparatus, reference numeral 900A denotes a main body of the image forming apparatus (hereinafter referred to as apparatus main body), and reference numeral 900B denotes an image forming portion configured to form image on a sheet. Reference numeral 950 denotes an image reading apparatus provided on the top of the apparatus main body 900A and provided with a document feeder 950A, and reference numeral 100 denotes a finisher, i.e., a sheet processing apparatus, arranged between the upper surface of the apparatus main body 900A and an image reading apparatus 950.

Here, the image forming portion 900B includes photoconductive drums (a) through (d) configured to form toner images in four colors, namely, yellow, magenta, cyan, and black, and an exposing unit 906 configured to radiate a laser beam on the basis of image information and form electrostatic latent images on the photoconductive drums. The photoconductive drums (a) through (d) are driven by a motor, not illustrated. Each photoconductive drum is provided with a primary charger, a developing unit and a transfer charger arranged in the periphery thereof and is unitized with them as process cartridges 901*a* through 901*d*.

The image forming portion 900B includes an intermediate transfer belt 902 driven and rotated in a direction indicated by an arrow, and a secondary transfer portion 903 configured to transfer a full-color image formed on the intermediate transfer belt 902 in sequence to a sheet P. By applying a transfer bias to the intermediate transfer belt 902 by transfer chargers 902*a* through 902*d*, the respective color toner images on the photoconductive drums are sequentially transferred to the intermediate transfer belt 902 in a superimposed manner. Accordingly, a full-color image is formed on the intermediate transfer belt.

The secondary transfer portion 903 includes a secondary transfer counter roller 903*b* configured to support the intermediate transfer belt 902 and a secondary transfer roller 903*a* configured to abut against the secondary transfer counter roller 903*b* through the intermediate transfer belt 902. In FIG. 1, reference numeral 909 denotes a registration roller, reference numeral 904 denotes a sheet feed cassette, reference numeral 908 denotes a pickup roller configured to feed the sheet P stored in the sheet feed cassette 904.

Next, an image forming operation of the image forming apparatus 900 having the above-described configuration will be described. When the image forming operation is started, first of all, the exposing unit 906 radiates a laser beam on the basis of image information from a personal computer or the like, not illustrated, and exposes surfaces of the photoconductive drums (a) through (d), the photoconductive drums (a) through (d) being uniformly charged to predetermined polarity and potential in sequence, and forms electrostatic latent images on the photoconductive drums (a) through (d) respectively. Subsequently, the electrostatic latent images are developed and visualized by toner.

For example, the photoconductive drum (a) is irradiated with a laser beam on the basis of an image signal having a yellow color component of an document via a polygon mirror or the like of the exposing unit 906 to form an electrostatic latent image of yellow on the photoconductive drum (a). The electrostatic latent image of yellow is developed by yellow toner from a developing unit and hence is visualized as a yellow toner image. Subsequently, the toner image arrives at a primary transfer portion where the photoconductive drum (a) and the intermediate transfer belt 902 come into contact with each other in association with the rotation of the photoconductive drum (a). When the toner image arrives at the first transfer portion, the yellow toner image on the photoconductive drum (a) is transferred to the intermediate transfer belt 902 by a primary transfer bias applied to the transfer charger 902*a* (primary transfer).

Subsequently, when the portion of the intermediate transfer belt 902 carrying the yellow toner image moves, a magenta toner image formed on the photoconductive drum (b) in the same manner as describe above by this time is transferred to the intermediate transfer belt 902 over the yellow toner image. In the same manner, as the intermediate transfer belt 902 moves, a cyan toner image and a black toner image are transferred over the yellow toner image and the magenta toner image in a superimposed manner at respective primary transfer portions. Accordingly, a full-color toner image is formed on the intermediate transfer belt 902.

In parallel to the toner image forming operation, the sheets P stored in the sheet feed cassette 904 are fed by the pickup roller 908 one by one. Next, the sheet P arrives at a registration roller 909 and is conveyed to the secondary transfer portion 903 at timing adjusted by registration roller 909 with the toner image. Subsequently, the toner image of four colors on the intermediate transfer belt 902 is transferred at once to the sheet P by the secondary transfer bias applied to the secondary transfer roller 903*a*, i.e., the transfer portion, in the secondary transfer portion 903 (secondary transfer).

Subsequently, the sheet P having the toner image transferred thereto is conveyed from the secondary transfer portion 903 to a fixing portion 905 while being guided by a conveyance guide 920 and receives heat and pressure so that the image is fixed when the sheet p passes through the fixing portion 905. Subsequently, the sheet P having the image fixed thereto passes through a discharge passage 921 provided on the downstream of the fixing portion 905, and then is discharged by a discharge roller pair 918, and is conveyed to the finisher 100.

Figure 2A:
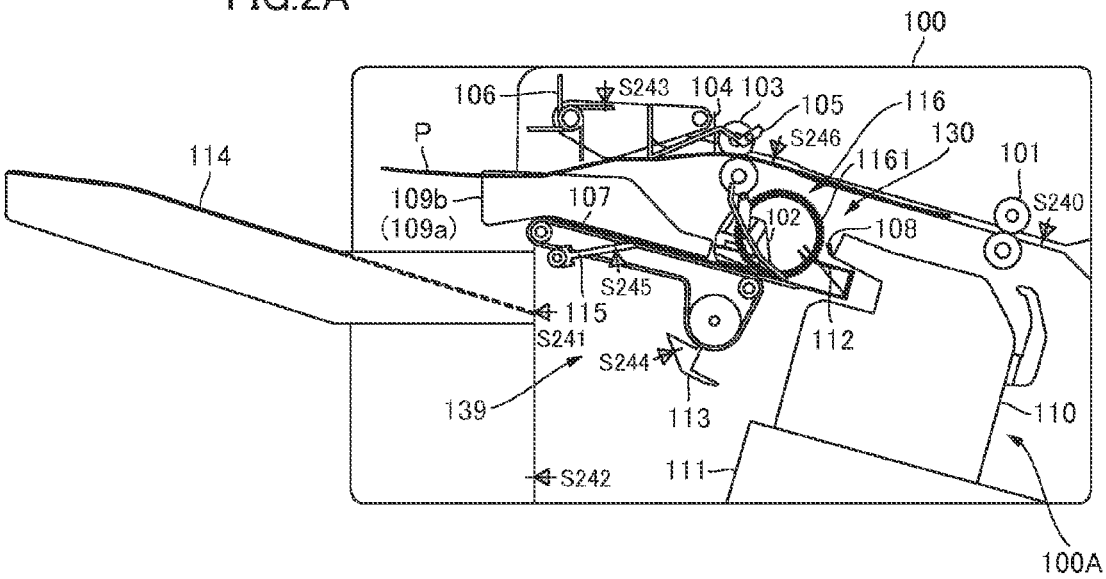
FIG. 2A is a schematic drawing illustrating a state of a finisher with a sheet conveyed by a sheet discharge roller.
Figure 2B:
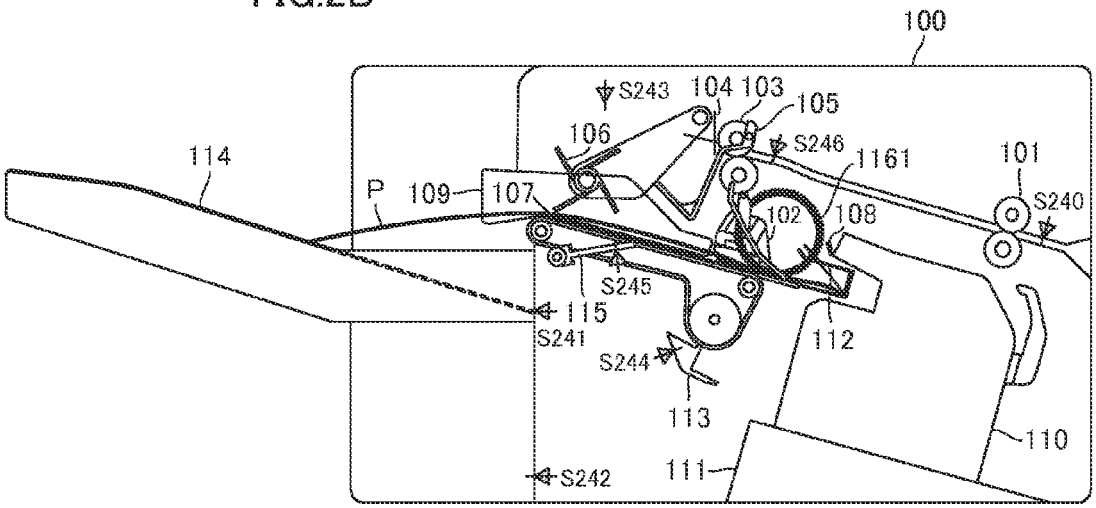
FIG. 2B is a schematic drawing illustrating a state of the finisher with a sheet discharged into an intermediate processing tray.
Figure 5A:
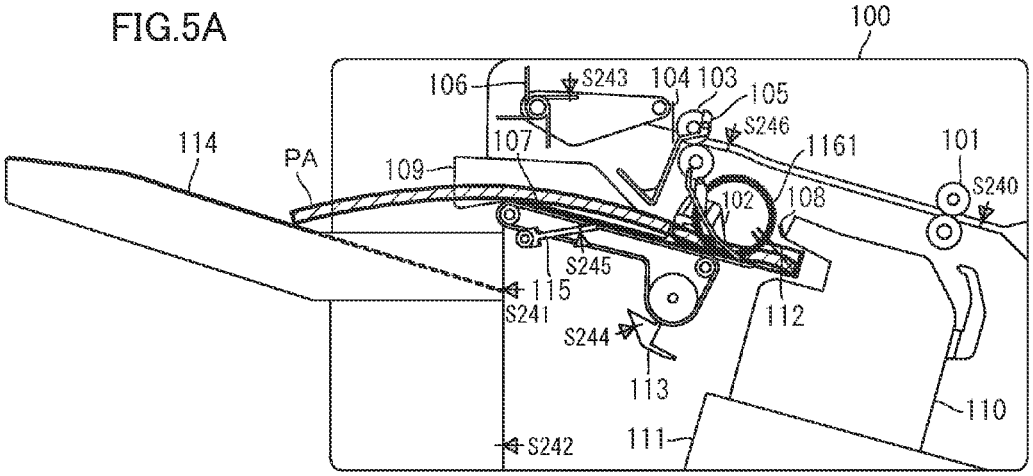
FIG. 5A is an explanatory drawing illustrating a sheet binding operation of the finisher.
Figure 5B:
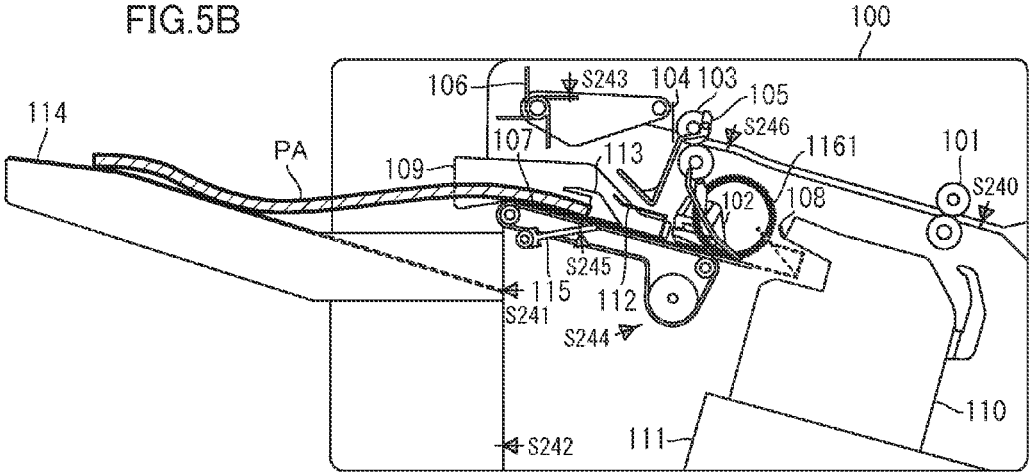
FIG. 5B is a schematic drawing illustrating a state of the finisher with a bound sheet bundle being discharged to a stacking tray.
Figure 5C:
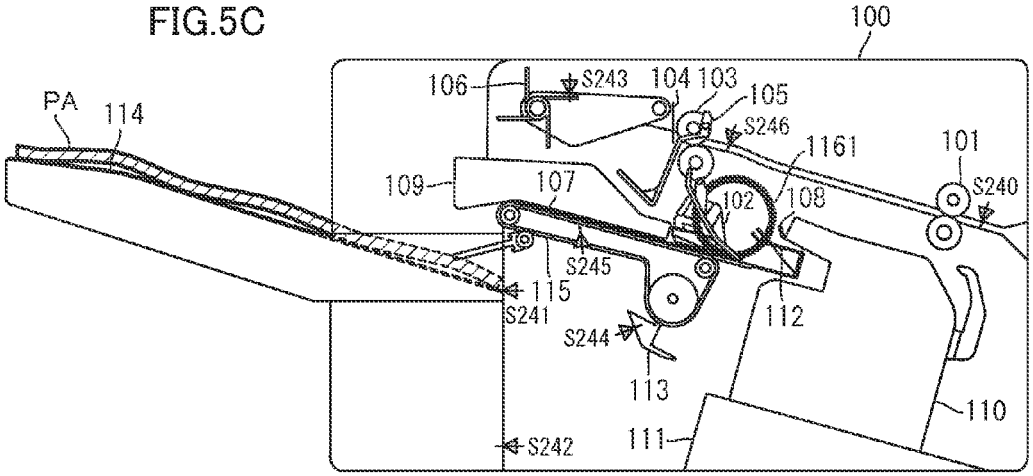
FIG. 5C is a schematic drawing illustrating a state of the finisher with the sheet bundle discharged to the stacking tray.

The finisher 100 receives the sheet P discharged from the apparatus main body 900A in sequence as illustrated in FIGS. 2A and 2B, and performs a process of aligning and bundling a plurality of received sheets into one bundle and a process of binding the bundled sheet bundle at upstream end in a sheet discharge direction (hereinafter, referred to as "trailing end"). As illustrated in FIGS. 5A through 5C, the finisher 100 is provided with a processing portion 139 configured to perform binding as needed and discharge and stack the sheet bundle on a stacking tray 114. The processing portion 139 includes an intermediate processing tray 107 as a sheet stacking portion configured to stack the sheet to be bound and a binding portion 100A provided with a stapler 110 configured to bind (staple) the sheets stacked on the intermediate processing tray 107 and a staple-less binding portion, not illustrated.

The intermediate processing tray 107 is provided with front and back aligning plates 109*a* and 109*b* that regulate (align) both side end positions in the width direction (the depth direction) of the sheet conveyed into the intermediate processing tray 107 from a direction orthogonal to the depth direction of the apparatus main body 900A.

The front and back aligning plates 109*a* and 109*b* as the side end aligning portion configured to align the side end positions in the width direction of the sheet stacked in the intermediate processing tray 107 are driven by an alignment motor M253 illustrated in FIG. 4 described later, and move in the width direction.

The front and back aligning plates 109*a* and 109*b* are normally moved to a receiving position where the sheet is received by the alignment motor M253 driven on the basis of a detection signal detected by an alignment HP sensor, not illustrated. When regulating the both side end positions of the sheet stacked on the intermediate processing tray 107, the alignment motor M253 is driven to move the front and back aligning plates 109*a* and 109*b* along the width direction into abutment with the both side ends of the sheets stacked on the intermediate processing tray 107.

A take-in paddle 106 and a knurled belt portion 116 are arranged above the intermediate processing tray 107. The take-in paddle 106 is configured to be moved downward by driving of the puddle lifting motor M252 illustrated in FIG. 4 descried later when the sheet is discharged to the intermediate processing tray 107, and rotates counterclockwise at the right timing by a paddle motor, not illustrated. Accordingly, the sheet P is conveyed toward the knurled belt portion 116. The take-in paddle 106 is configured to be moved upward to a HP (home position) not disturbing the discharged sheet by reverse driving of the puddle lifting motor M252 on the basis of the detection information detected by the puddle HP sensor S243 before the sheet is conveyed to the processing portion 139.

The knurled belt portion 116 includes a knurled belt 1161, i.e., an endless sheet conveyance portion (endless belt), rotated by a conveyance motor M250 illustrated in FIG. 4 and described later, and configured to convey the sheet stacked in the intermediate processing tray 107 in contact with the upper surface thereof. When the sheet P is conveyed by the take-in paddle 106, the sheet P is drawn by the knurled belt 1161, is conveyed toward the trailing end stopper 108 as an aligning portion configured to align the position of the sheet P in the sheet conveying direction, and is aligned with the sheets already stacked on the intermediate processing tray 107 by being abutted against the trailing end stopper 108. In the present embodiment, the take-in paddle 106, the knurled belt portion 116, the trailing end stopper 108, and the front and back aligning plates 109*a* and 109*b* constitute an aligning portion 130 configured to align the sheet stacked on the intermediate processing tray 107.

In FIGS. 2A and 2B, reference numeral 112 denotes a trailing end assist.

The trailing end assist 112 is moved from a position not interfering with the movement of the stapler 110 to a receiving position where the sheet is received by an assist motor M254 driven on the basis of a detection signal from an assist HP sensor S244 described later and illustrated in FIG. 4. The trailing end assist 112 discharges the sheet bundle into the stacking tray 114 after the sheet bundle has been bound as described later.

The finisher 100 is provided with an inlet roller 101 and a sheet discharge roller 103 configured to take the sheet into the apparatus, and the sheet P discharged from the apparatus main body 900A is delivered to the inlet roller 101.

At this time, the sheet delivering timing is detected by an inlet port sensor S240 simultaneously. The sheet P delivered to the inlet roller 101 is discharged to the intermediate processing tray 107 in sequence by the sheet discharge roller 103, i.e., a sheet discharge portion, and subsequently, is brought into abutment with the trailing end stopper 108 by returning portion such as the take-in paddle 106 or the knurled belt 1161. Accordingly, alignment of the sheet P in the sheet conveying direction is performed and an aligned sheet bundle is formed.

In FIGS. 2A and 2B, reference numeral 105 denotes a trailing end dropper, and the trailing end dropper 105 is pushed upward by the sheet P passing through the sheet discharge roller 103 as illustrated in FIG. 2A. When the sheet P passes through the sheet discharge roller 103, the trailing end dropper 105 drops with its own weight as illustrated in FIG. 2B, and pushes the trailing end of the sheet P downward from above.

Reference numeral 104 denotes a destaticizing needle, and reference numeral 115 denotes a bundle holder. The bundle holder 115 presses the sheet bundle stacked on the stacking tray 114 by being rotated by a bundle holding motor M255 described later and illustrated in FIG. 4. Reference sign S242 denotes a tray lower limit sensor, and reference sign S245 denotes a bundle holder HP sensor. Reference sign S241 is a tray HP sensor, and when the sheet bundle blocks light to the tray HP sensor S241, the tray lifting motor M251 illustrated in FIG. 4 moves the stacking tray 114 downward until the tray HP sensor S241 is brought into a light-transmitting state, whereby the position of the sheet plane is fixed.

Figure 3:
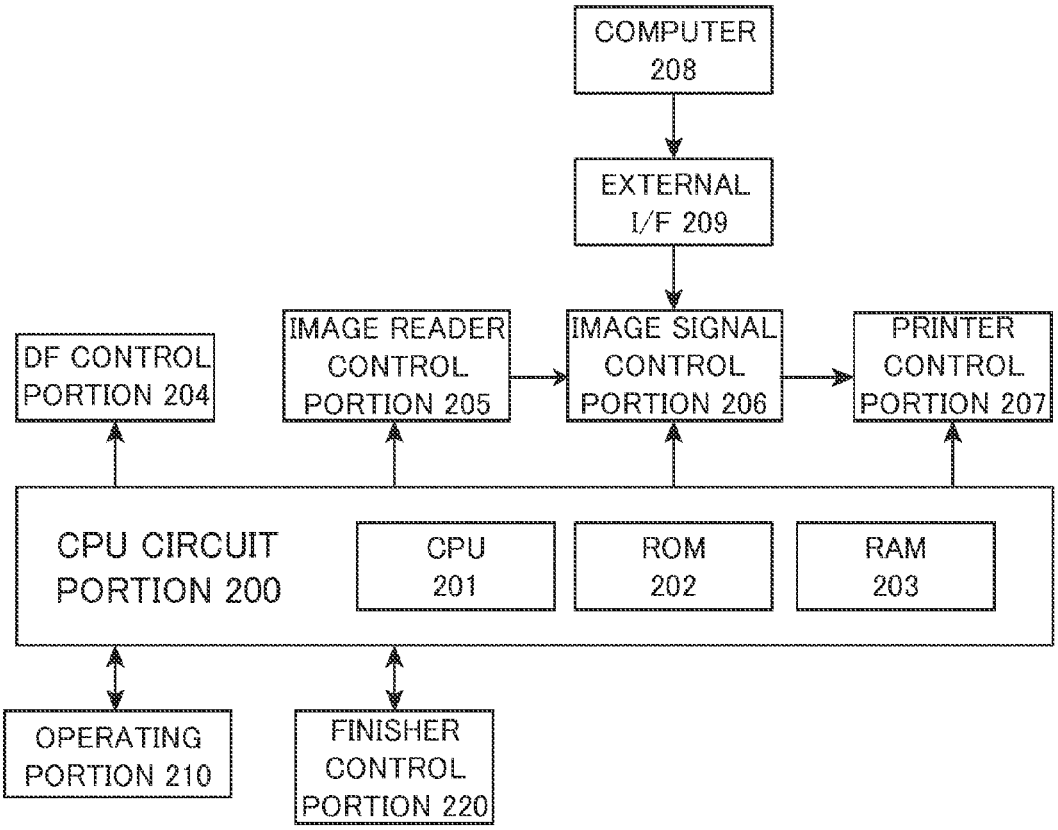
FIG. 3 is a control block diagram of the image forming apparatus.

FIG. 3 is a control block diagram of the image forming apparatus 900. In FIG. 3, reference numeral 200 denotes a CPU circuit portion, i.e., a control portion, arranged at a predetermined position in the apparatus main body 900A as illustrated in FIG. 1, and configured to control the apparatus main body 900A and the finisher 100. The CPU circuit portion 200 includes a CPU 201, a ROM 202 having a control program or the like stored therein, and a RAM 203 known as an area for temporarily holding control data, and a work area for computation in associated with the control.

In FIG. 3, reference numeral 209 denotes an external interface between the image forming apparatus 900 and an external PC (computer) 208. Upon reception of print data from the external PC 208, the external interface 209 expands the data into a bitmap image and outputs the bitmap image to in an image signal control portion 206 as image data.

The image signal control portion 206 outputs the data to a printer control portion 207, and the printer control portion 207 outputs the data from the image signal control portion 206 to an exposure control portion, not illustrated. It is noted that an image of the document read by an image sensor, not illustrated, provided in the image reading apparatus 950 is output from an image reader control portion 205 to the image signal control portion 206, and the image signal control portion 206 outputs the image output to the printer control portion 207.

An operating portion 210 includes a plurality of keys used for setting respective functions relating to image formation, a display portion configured to display a set state, and the like. Key signals corresponding to an operation of respective keys by a user are output to the CPU circuit portion 200, and on the basis of the signal from the CPU circuit portion 200, corresponding information is displayed on the display portion.

The CPU circuit portion 200 is configured to control the image signal control portion 206 according to the control program stored in the ROM 202 and the setting of the operating portion 210, and controls the document feeder 950A (see FIG. 1) through a DF (document feeder) control portion 204. The CPU circuit portion 200 also controls the image reading apparatus 950 (see FIG. 1) through the image reader control portion 205, the image forming portion 900B (see FIG. 1) through the printer control portion 207, and the finisher 100 through a finisher control portion 220, respectively.

In the present embodiment, the finisher control portion 220 as a control portion is mounted on the finisher 100, and performs drive control of the finisher 100 by sending and receiving information with the CPU circuit portion 200. It is also possible to dispose the finisher control portion 220 on the apparatus main body side integrally with the CPU circuit portion 200, and control the finisher 100 directly from the apparatus main body side.

Figure 4:
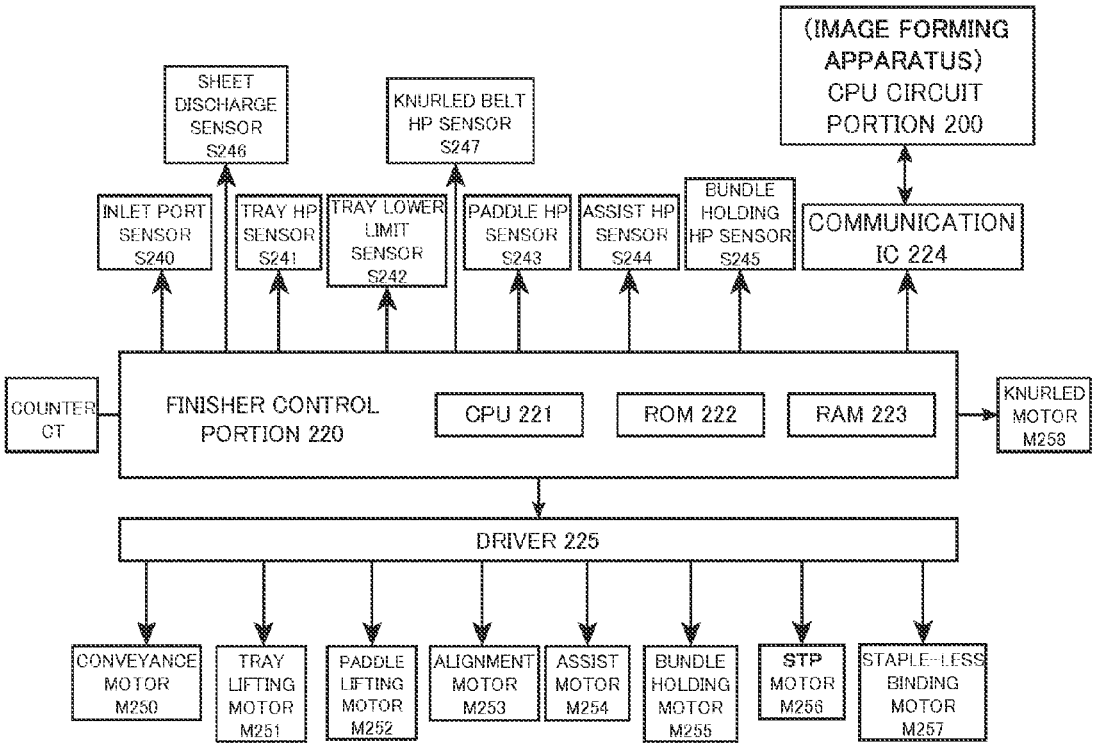
FIG. 4 is a control block diagram of the finisher.

FIG. 4 is a control block diagram of the finisher 100 of the present embodiment.

The finisher control portion 220 includes a CPU (microcomputer) 221, a ROM 222, and a RAM 223. The finisher control portion 220 exchanges data by communicating with the CPU circuit portion 200 through a communication IC 224, executes respective programs stored in the ROM 222 on the basis of an instruction from the CPU circuit portion 200, and controls driving of the finisher 100.

The finisher control portion 220 drives the conveyance motor M250, the tray lifting motor M251, the puddle lifting motor M252, the alignment motor M253, the assist motor M254, the bundle holding motor M255, and a STP motor M256 through a driver 225. The finisher control portion 220 drives a staple-less binding motor M 257 and a knurled motor M258 through the driver 225.

The inlet port sensor S240, a sheet discharge sensor S246, the tray HP sensor S241, the tray lower limit sensor S242, the puddle HP sensor S243, the assist HP sensor S244, and the bundle holder HP sensor S245 are connected to the finisher control portion 220. The sheet discharge sensor S246, a knurled belt HP sensor S247, and a counter CT configured to count the number of sheets stacked on the intermediate processing tray 107 are connected to the finisher control portion 220. The finisher control portion 220 drives the alignment motor M253, the knurled motor M258, and the like on the basis of detection signals from the respective sensors described above.

Subsequently, the sheet binding operation of the finisher 100 according to the present embodiment will be described. The sheet P discharged from the image forming apparatus 900 is delivered to the inlet roller 101 driven by the conveyance motor M250 as illustrated in FIG. 2A described above. At this time, the sheet delivering timing is detected from the leading end of the sheet P by the inlet port sensor S240 simultaneously.

Subsequently, the sheet P delivered to the inlet roller 101 is delivered in turn from the inlet roller 101 to the sheet discharge roller 103, and is conveyed while the leading end portion lifts the trailing end dropper 105. Simultaneously, the sheet P is discharged into the intermediate processing tray 107 while being destaticized by the destaticizing needle 104. The sheet P discharged into the intermediate processing tray 107 by the sheet discharge roller 103 is held by the weight of the trailing end dropper 105 from above, so that the time required for the trailing end of the sheet P to drop onto the intermediate processing tray 107 is reduced.

Subsequently, the finisher control portion 220 performs control relating to the sheet discharged to the intermediate processing tray 107 on the basis of a detection signal of the trailing end of the sheet P detected by the sheet discharge sensor S246.

That is, as illustrated in FIG. 2B described above, the puddle lifting motor M252 is driven to lower the take-in paddle 106 toward the intermediate processing tray 107 and bring the paddle 106 into contact with the sheet P. At this time, the take-in paddle 106 is rotated counterclockwise by the conveyance motor M250. Therefore, the sheet P is conveyed rightward in the drawing toward the trailing end stopper 108 by the take-in paddle 106 and then the trailing end of the sheet P is delivered to the knurled belt 1161.

When the trailing end of the sheet P is delivered to the knurled belt 1161, the puddle lifting motor M252 is driven in the reverse direction to cause the take-in paddle 106 to move upward. When the puddle HP sensor S243 detects that the take-in paddle 106 arrives at the HP, the finisher control portion 220 stops driving of the puddle lifting motor M252.

Subsequently, the sheet P delivered to the knurled belt 1161 is drawn by the knurled belt 1161, and the trailing end abuts against the trailing end stopper 108.

After the trailing end of the sheet P has brought into abutment with the trailing end stopper 108, the knurled belt 1161 rotates while slipping with respect to the sheet P, so that the sheet P is constantly biased toward the trailing end stopper 108. With this slipping conveyance, skewing of the sheet P abutting against the trailing end stopper 108 may be corrected.

Subsequently, after the sheet P has brought into abutment with the trailing end stopper 108 in this manner, the finisher control portion 220 drives the alignment motor M253 to move the aligning plate 109 in the width direction of the sheet P, and align the position in the width direction of the sheet P. By performing a series of operations described above for a predetermined number of sheets to be bound repeatedly, the sheet bundle PA aligned on the intermediate processing tray 107 as illustrated in FIG. 5A is formed.

Subsequently, after the aligning operation has been performed, if the binding mode is selected, binding is performed by the binding portion. That is, in the case where binding is performed on the sheet bundle with a staple, the sheet bundle is bound by driving the STP motor M256 that drives the stapler 110. In the case where the staple-less binding is performed on the sheet bundle, the sheet bundle is bound by driving the staple-less binding motor M 257 configured to drive the staple-less binding portion, not illustrated.

Subsequently, as illustrated in FIG. 5B, the trailing end of the sheet bundle PA is pushed by the trailing end assist 112 and a discharge claw 113 which are the sheet discharge portion and driven synchronously by the assist motor M254, and the sheet bundle PA on the intermediate processing tray 107 is discharged onto the stacking tray 114 in the form of a bundle.

Subsequently, as illustrated in FIG. 5C, in order to prevent the sheet bundle PA stacked on the stacking tray 114 from being pushed out in the direction of conveyance by a sheet bundle discharged subsequently, the bundle holder 115 rotates counterclockwise to hold the trailing end portion of the sheet bundle PA. If the sheet bundle PA blocks light to the tray HP sensor S241 after the bundle holding operation by the bundle holder 115 has completed, the tray lifting motor M251 moves the stacking tray 114 downward until the tray HP sensor S241 is brought into a light-transmitting state, whereby the position of the sheet plane is determined. By performing a series of operations described above repeatedly, the required number of the sheet bundles PA may be discharged onto the stacking tray 114.

It is noted that if the stacking tray 114 is moved downward and blocks light toward the tray lower limit sensor S242 during the operations, the full of the stacking tray 114 is detected and the finisher control portion 220 notifies the full of the stacking tray 114 to the CPU circuit portion 200 of the image forming apparatus 900. The CPU circuit portion 200 stops formation of the image when the full of the stacking tray 114 is notified. Subsequently, when the sheet bundle on the stacking tray 114 are removed, the stacking tray 114 moves upward until blocking light to the tray HP sensor S241 and then moves downward to bring the tray HP sensor S241 into a light-transmitting state, whereby the sheet plane of the stacking tray 114 is determined again. Accordingly, image formation of the image forming apparatus 900 is restarted.

Figure 6A:
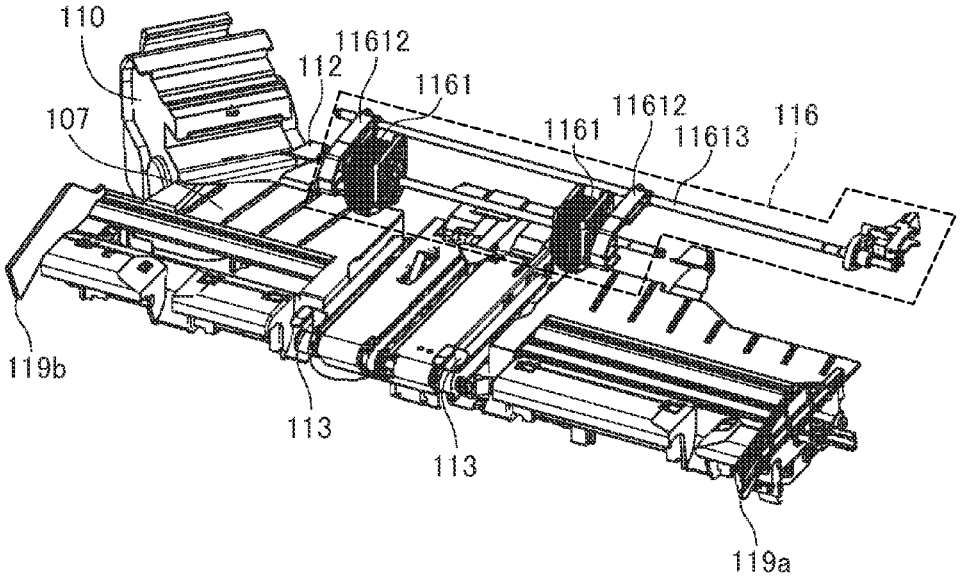
FIG. 6A is a perspective view illustrating a configuration of a knurled belt portion provided on the finisher.
Figure 6B:
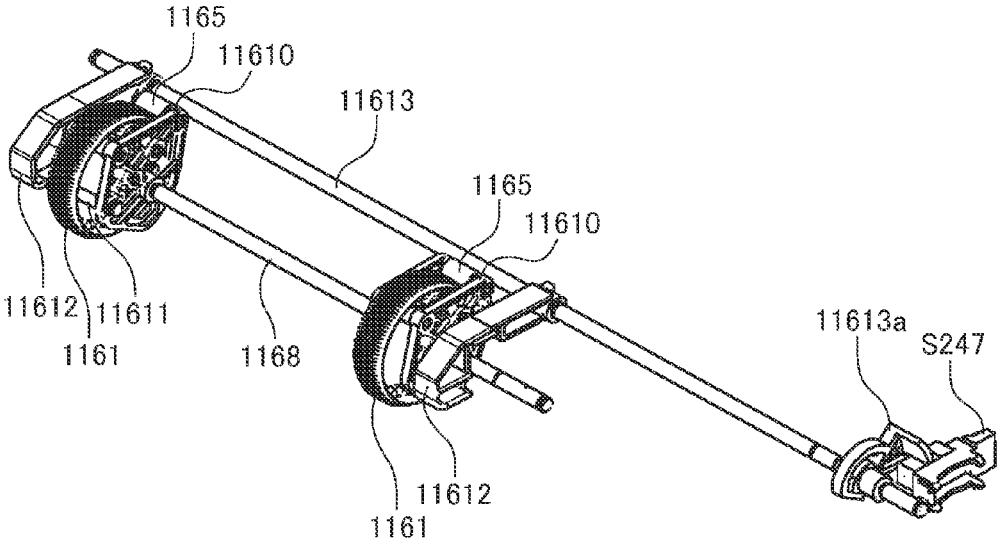
FIG. 6B is an enlarged view of the knurled belt portion illustrated in FIG. 6A.
Figure 7A:
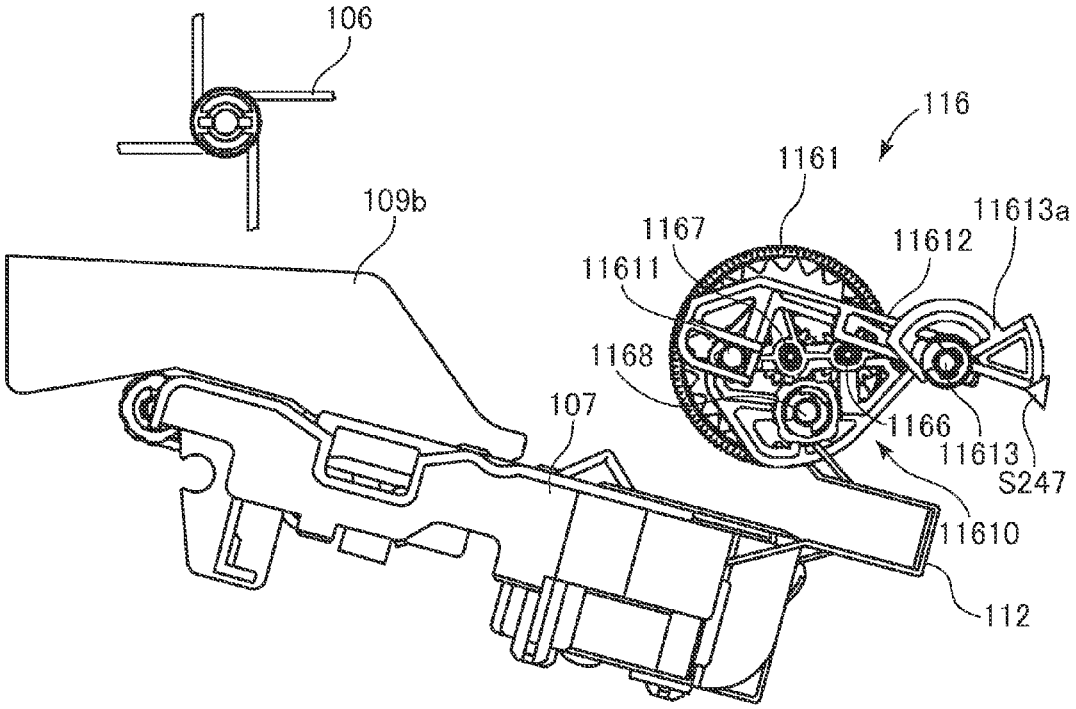
FIG. 7A is a side view illustrating a configuration of the knurled belt portion.
Figure 7B:
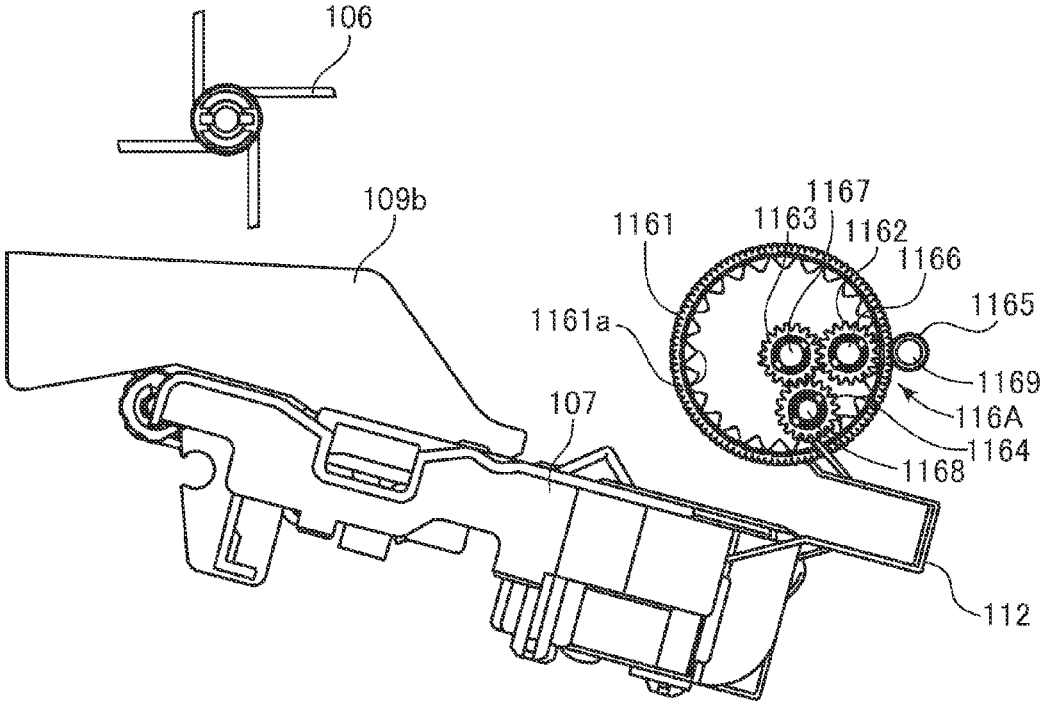
FIG. 7B is a side view illustrating a gear mechanism of the knurled belt portion illustrated in FIG. 7A.

FIGS. 6A and 6B and FIGS. 7A and 7B are drawings illustrating a configuration of the knurled belt portion 116 of the present embodiment. As illustrated in FIGS. 6A and 6B, the knurled belt portion 116 includes the knurled belts 1161 and holders 11612 configured to hold the knurled belts 1161. Although there are two sets of the knurled belts and members, e.g., the holder 11612, a frame 11610, first through third gears 1162 through 1164, associated with the knurled belt, the following description will be given for one set of those two sets for the sake of simplicity of the description, hereinafter. The knurled belt portion 116 also includes first through third gears 1162 through 1164 arranged inside the knurled belt 1161 and a driven roller 1165 opposing the first gear 1162 and configured to nip the knurled belt 1161 with the first gear 1162 as illustrated in FIG. 7B.

The knurled belt portion 116 further includes a frame 11610 illustrated in FIG. 7A configured to hold rotation shafts 1166, 1167, and 1169 of the first and second gears 1162 and 1163 and the driven roller 1165. A rotation shaft 1168 of the third gear (first drive force transmitting rotating member) 1164 is provided inside the knurled belt 1161 and arranged in a direction orthogonal to the sheet conveying direction of the knurled belt 1161 in parallel to the intermediate processing tray 107. The rotation shaft 1168 is rotatably supported by the frame 11610.

As described later, when the knurled belt 1161 is raised, the frame 11610, i.e. a supporting portion, configured to rotatably support the second gear (second drive force transmitting rotating member) 1163 and the driven roller 1165 swings about the rotation shaft 1168 of the third gear 1164 as a supporting point. That is, the rotation shaft 1168 of the third gear 1164 serves as a swinging shaft (lifting shaft) of the frame 11610 provided above the intermediate processing tray 107 so as to be rotatable (so as to be raised and lowered), and the third gear 1164 is provided on the swinging shaft of the frame 11610.

The rotation shaft 1168 of the third gear 1164 is rotated upon reception of a drive force from the conveyance motor M250 illustrated in FIG. 4 described above. This rotation is transmitted to the first gears 1162 configured to nip the knurled belt 1161 with the driven roller 1165 through the third and second gears 1164 and 1163 as a drive transmission portion. The first gear 1162 as a drive rotating member and the third gear 1164 as an auxiliary rotating member are in contact with an inner peripheral surface of the knurled belt 1161 and rotatably support the knurled belt 1161. Accordingly, when the conveyance motor M250, i.e., a shaft drive portion, is driven and the first gear 1162 and the third gear 1164 are rotated, the knurled belt 1161 rotates correspondingly.

In the embodiment, the first gear 1162 and the driven roller 1165 as a driven rotating member configured to nip the knurled belt 1161 with the first gear 1162 constitute a rotating portion 116A configured to rotate the knurled belt 1161. The first, second and third gears 1162, 1163 and 1164 are configured to rotate at the same velocity. Accordingly, the knurled belt 1161 moves between the first gear 1162 and the third gear 1164 while maintaining a constant tensile force without being tensed nor sagged.

In the embodiment, the knurled belt portion 116 includes two sets of the first through third gears 1162 through 1164 corresponding to two knurled belts 1161 as describe above and each set of gears is provided at predetermined interval on the rotation shafts 1166, 1167, and 1168. A retainer 1161*a* is provided at a widthwise center between the sets of gears in the width direction orthogonal to the direction of rotation of the knurled belt 1161. Retention of the knurled belt 1161 is achieved by positioning the retainer 1161*a* between the two sets of the first through third gears 1162 to 1164.

The holder 11612 is fixed to a holder shaft 11613 configured to driven by the knurled motor M258 capable of rotating in normal and reverse directions illustrated in FIG. 4 described above. Accordingly, when the holder shaft 11613 is rotated, the holder 11612 turns upward and downward. A flag 11613*a* is provided at one end of the holder shaft 11613, and the finisher control portion 220 detects that the knurled belts 1161 are at a home position by the detection of the flag 11613*a* by the knurled belt HP sensor S247.

The holder 11612 includes a supporting shaft 11611 fixed at one end thereof to the frame 11610 so as to be locked thereto. Accordingly, when the holder 11612 is turned upward and downward, the frame 11610 swings about the rotation shaft 1168 of the third gear 1164 through the supporting shaft 11611, whereby the knurled belt 1161 is raised and lowered. That is, when the knurled motor M258 rotates, the holders 11612 are turned upward and downward, and the knurled belts 1161 move to abutment positions where the knurled belts 1161 come into contact with the sheet on the intermediate processing tray 107 and to the home position as a separate position where the knurled belts 1161 separates from the sheet on the intermediate processing tray 107.

The abutment position of the knurled belt 1161 needs to be shifted upward in association with an increase in the number of stacked sheets so as to avoid conveying forces of the knurled belts 1161 in conveying the sheet from becoming excessive.

Therefore, in the present embodiment, the finisher control portion 220 changes the position of the knurled belts 1161 according to the number of stacked sheets of the sheet bundle on the processing tray (on the sheet stacking portion) to make the sheet conveying forces of the knurled belts 1161 fall within a predetermined range. In other words, the finisher control portion 220 controls the knurled motor M258 such that the endless belt is positioned at a position corresponding to a number of sheets stacked on the sheet stacking portion.

Figure 8A:
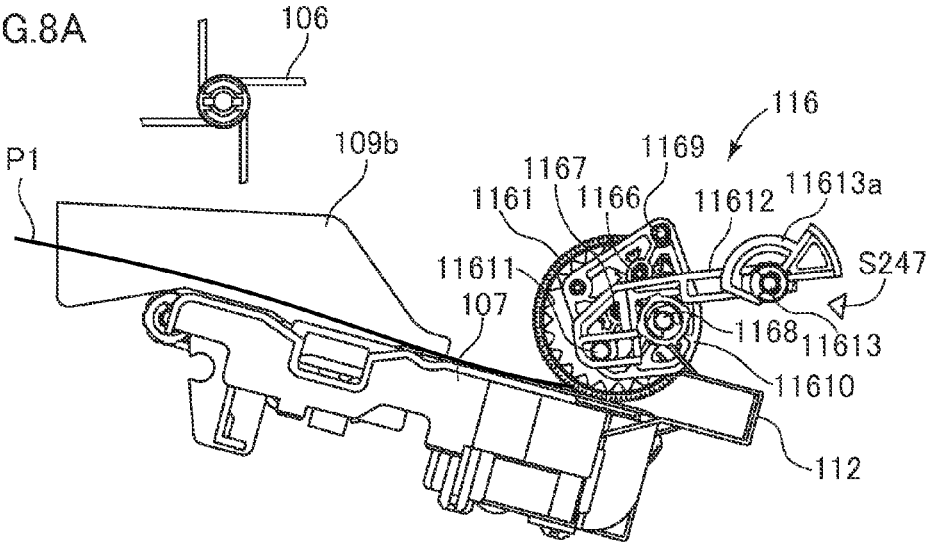
FIG. 8A is a schematic view illustrating a state of the knurled belt portion with a knurled belt moved downward to a large extent.
Figure 8B:
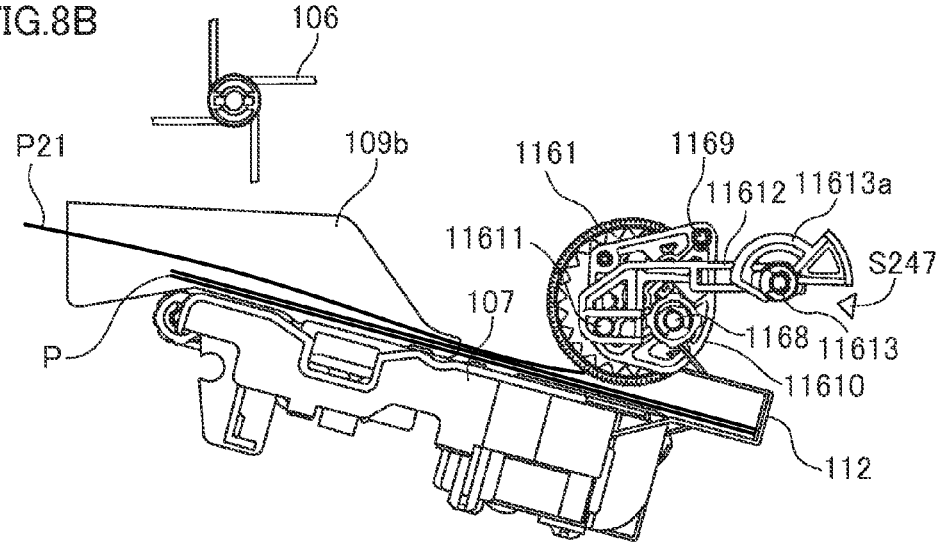
FIG. 8B is a schematic drawing illustrating the state of the knurled belt portion with the knurled belt lowered to a medium extent.
Figure 8C:
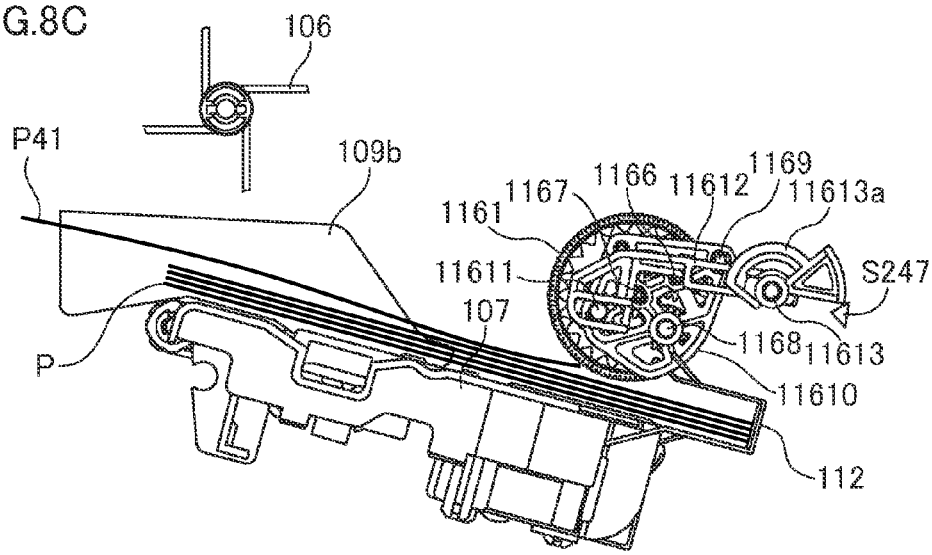
FIG. 8C is a schematic drawing illustrating the state of the knurled belt portion with the knurled belt lowered to a small extent.

FIGS. 8A to 8C are drawings illustrating the state of the knurled belt portion 116 when conveying the sheet P on the intermediate processing tray 107. FIG. 8A illustrates a state of conveying a topmost sheet P1. FIG. 8B illustrates a state of conveying a $21^{st}$ sheet P21 in a state in which 20 sheets of 64 g/m$^2$ are stacked on the intermediate processing tray. FIG. 8C illustrates a state of conveying a 41$^{st}$ sheet P41 in a state in which 40 sheets of 64 g/m$^2$ are stacked on the intermediate processing tray.

Here, in this embodiment, a pulse motor is used as the knurled motor M258 as a drive portion configured to drive the holders 11612 as lifting portion configured to raise and lower the frames 11610. The raising and lowering amount (swinging amount) of the knurled belt 1161 that moves upward and downward integrally with the frame 11610 is controlled by driving the knurled motor M258 at the number of pulses according to the number of stacked sheets.

Figure 9:
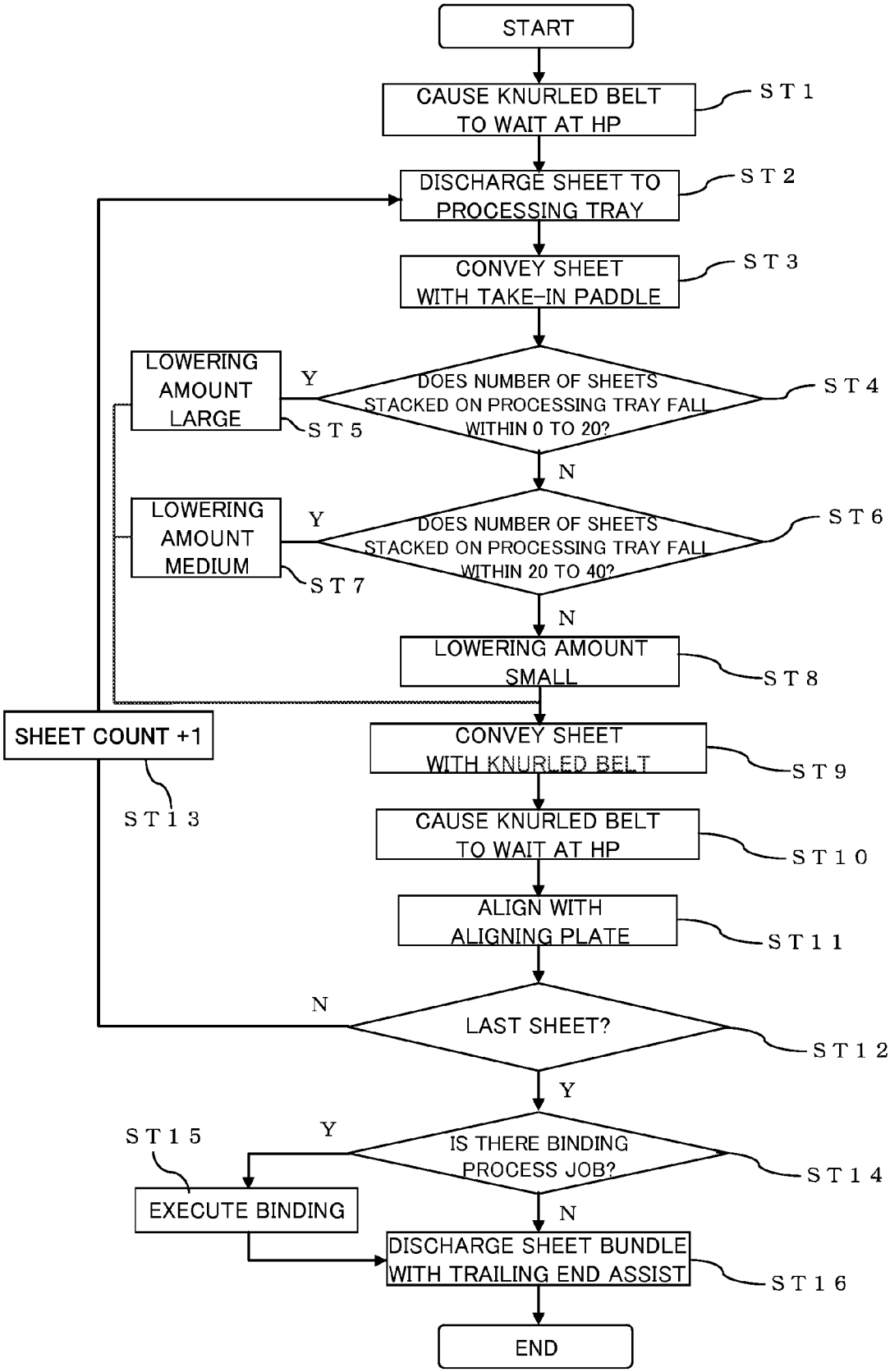
FIG. 9 is a flowchart for explaining a sheet processing operation of the finisher.

Subsequently, a sheet processing operation of the finisher 100 according to the present embodiment will be described with reference to a flowchart illustrated in FIG. 9. When the sheet processing operation (job) is started, the finisher control portion 220 drives the knurled motor M258. When the knurled belt HP sensor S247 detects the flag 11613*a* on the holder shaft 11613, the knurled motor M258 is stopped. Accordingly, the knurled belts 1161 are caused to wait at the home position (ST1).

Subsequently, the sheet P is discharged into the intermediate processing tray 107 by the sheet discharge roller 103 (ST2), and the sheet P is conveyed to the knurled belt portion 116 by the take-in paddle 106 (ST3).

Subsequently, the finisher control portion 220 drives the knurled motor M258, and lowers knurled belt 1161. At this time, the finisher control portion 220 determines whether the number of sheets stacked on the intermediate processing tray 107 falls within a range from 0 to 20 from information from the counter CT (ST4). When the number of stacked sheets falls within the range from 0 to 20 (Y in ST4), the finisher control portion 220 increases the lowering amount of the knurled belt 1161 as illustrated in FIG. 8A (ST5). When the number of stacked sheets does not fall within the range from 0 to 20 (N in ST4), whether the number of stacked sheets falls within a range from 20 to 40 is determined (ST6). If the number of stacked sheets falls within the range from 20 to 40 (Y in ST6), the lowering amount is reduced as illustrated in FIG. 8B, and the lowering amount is set to medium (ST7).

If the number of stacked sheets does not fall within the range from 20 to 40 (N in ST6), the number of stacked sheets is determined to fall within a range from 40 to 50. Therefore, the lowering amount is further reduced as illustrated in FIG. 8C, and the lowering amount is set to small (ST8). Before lowering the knurled belts 1161 by an amount corresponding to the number of stacked sheets, driving of the conveyance motor M250 is started and the knurled belts 1161 are rotated. Accordingly, when the knurled belt 1161 lowers by the amount corresponding to the number of stacked sheets subsequently, the knurled belts 1161 come into contact with the sheet stacked in the intermediate processing tray 107 while rotating, convey the sheet toward the trailing end stopper 108 (ST9), and aligns the sheet.

When the alignment of the sheet P with sheet already stacked on the intermediate processing tray 107 in the sheet conveying direction by the trailing end stopper 108 is terminated, the finisher control portion 220 drives the knurled motor M258 to rotate in the reverse direction, and raises the knurled belts 1161. When the knurled belt HP sensor S247 detects the flag 11613*a* of the holder shaft 11613, the knurled motor M258 is stopped and makes the knurled belts 1161 wait at the home position (ST10). Subsequently, the alignment motor M253 illustrated in FIG. 4 described above is driven, and alignment of the sheet P in the width direction is performed by using the aligning plate 109 (ST11).

After a series of aligning operations are terminated, the finisher control portion 220 determines whether the sheet P is the last sheet (ST12). When it is not the last sheet (N in ST12), the number of sheets to be counted by the counter CT is incremented by one (ST13). When it is the last sheet (Y in ST12), the presence or absence of the following binding job is determined (ST14).

When a binding job is selected (Y in ST14), the STP motor M256 or the staple-less binding motor M 257 is driven, and binding is executed by the stapler 110 or the staple-less binding portion (ST15). Subsequently, the assist motor M254 is driven and the sheet bundle is discharged to the stacking tray 114 by the trailing end assist 112 (ST16). If the binding job is not selected (N in ST14), the sheet bundle is discharged by the trailing end assist 112 to the stacking tray 114 (ST16).

In the present embodiment, as described above, the lowering amount of the knurled belts 1161 is controlled by driving the knurled motor M258 at the number of pulses corresponding to the number of stacked sheets. Also, the frame 11610 that hold the rotation shafts 1166 and 1167 of the first and second gears and the rotation shaft 1169 of the driven roller 1165 is supported so as to be swingable about the rotation shaft 1168 of the third gear 1164 in the present embodiment.

Accordingly, when lowering the knurled belt 1161 corresponding to the number of stacked sheets, the knurled belts 1161 can be lowered while maintaining the positional relationship at least between the first gear 1162 and the third gear 1164 constant by lowering the frames 11610. Consequently, the tensile force between the first gear 1162 and the third gear 1164 of each knurled belt 1161 can be maintained constant. In other words, even though the positions of the knurled belts 1161 are changed according to the number of stacked sheets, the tensile force of the knurled belts 1161 may be maintained constant.

As described thus far, in the present embodiment, the rotation shaft 1168 of the third gear 1164 as the lifting shaft of frame 11610 is provided inside the knurled belt 1161. When lowering the knurled belts 1161 according to the number of stacked sheets, the frame 11610 is swung about the rotation shaft 1168 of the third gear 1164, so that the knurled belt 1161 is lowered integrally with the frame 11610. In this manner, since the knurled belt 1161 is raised and lowered according to the number of stacked sheets and is rotated at a predetermined rotation speed, the circular shape can be maintained without deforming the knurled belt 1161 by a centrifugal force. Therefore, the tensile force may be maintained constant.

Accordingly, even when lowering the knurled belts 1161 according to the number of stacked sheets, the positional relationship (distance) between the first gear 1162 and the third gear 1164 can be maintained constant so that the tensile forces of the knurled belts 1161 are maintained constant. Consequently, increase in conveying force can be prevented, so that the position of the sheet in the sheet conveying direction may be aligned by the knurled belt 1161 without impairing alignment of the sheet. Even when the hardness of the knurled belts 1161 is changed due to a change in atmospheric temperature or time degradation, the tensile force of the belt is not changed due to the movement of the knurled belt 1161, so that deviation in conveying force may be restrained.

Figure 10:
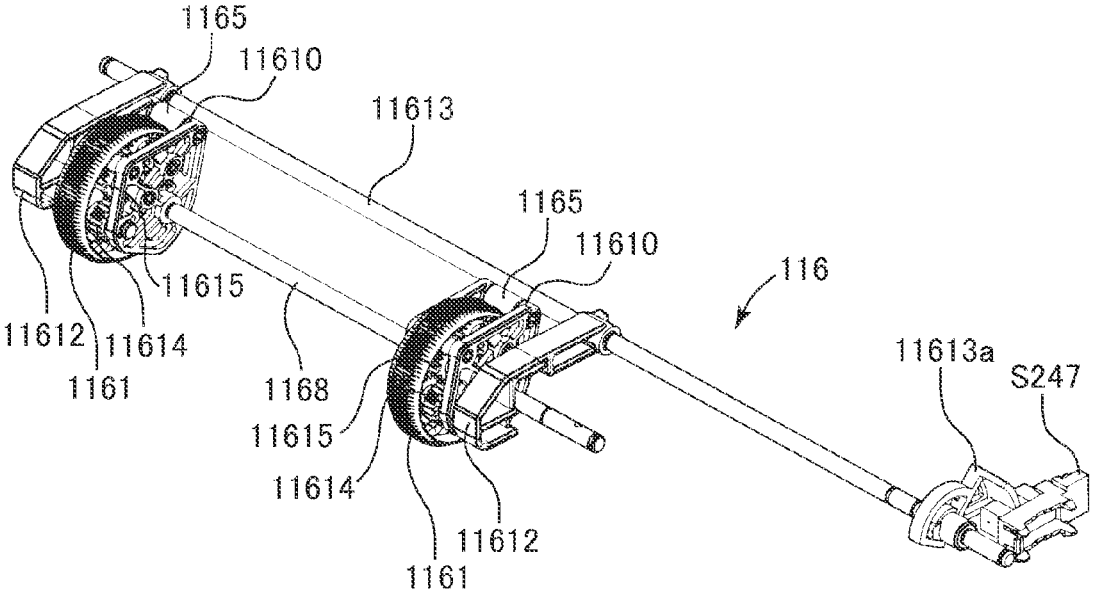
FIG. 10 is a schematic drawing illustrating a configuration of the knurled belt portion provided in a sheet processing apparatus of a second embodiment.
Figure 11A:
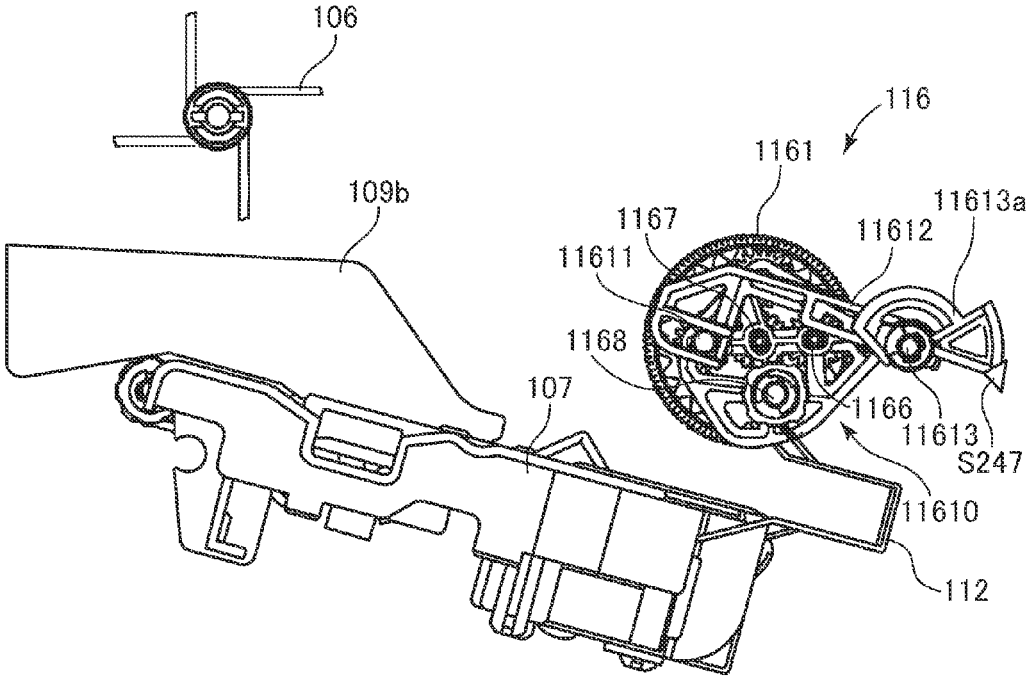
FIG. 11A is a drawing illustrating a configuration of the knurled belt portion of the second embodiment.
Figure 11B:
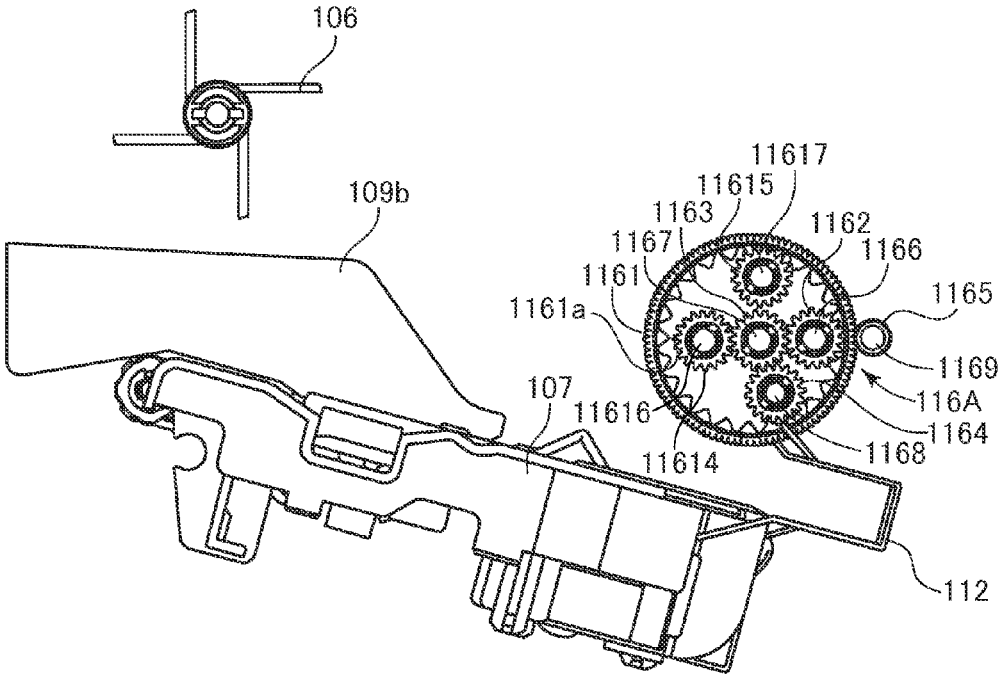
FIG. 11B is a side view illustrating a gear mechanism of the knurled belt portion illustrated in FIG. 11A.

Next, a second embodiment of the invention will be described. FIG. 10 and FIGS. 11A and 11B are drawings for explaining a configuration of the knurled belt portion provided in a sheet processing apparatus according to the second embodiment. In FIG. 10 and FIGS. 11A and 11B, the same reference numerals as those in FIGS. 6A and 6B described above, and FIGS. 7A and 7B indicate the same or the corresponding portions.

As illustrated in FIG. 10 and FIGS. 11A and 11B, the knurled belt portion 116 is provided with auxiliary gears 11614 and 11615 as auxiliary rotating members configured to restrict the deformation of the knurled belt 1161 in cooperation with the third gear 1164 inside the knurled belt 1161. Rotating axes 11616 and 11617 of the auxiliary gears 11614 and 11615 illustrated in FIG. 11B are rotatably supported by the frame 11610 as illustrated in FIG. 11A.

Figure 12A:
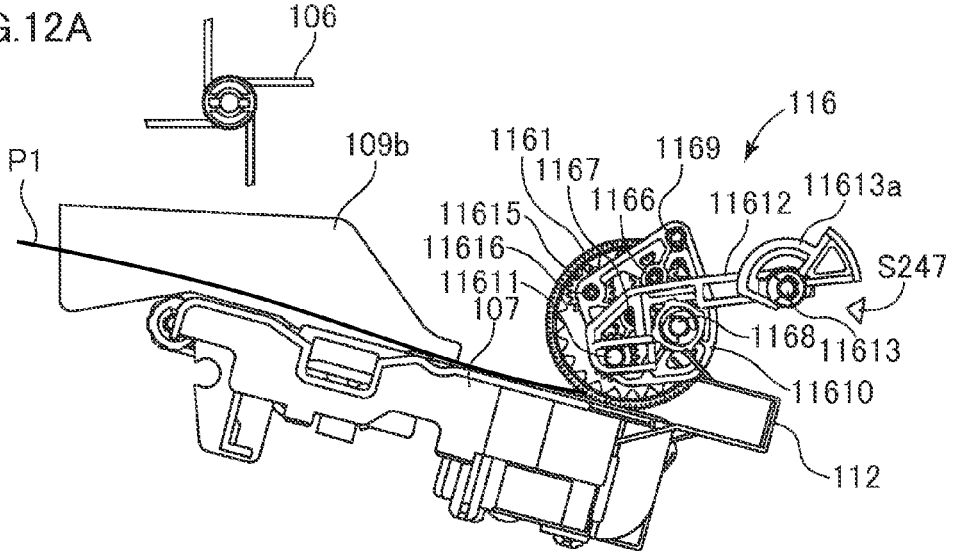
FIG. 12A is a schematic view illustrating a state of the knurled belt portion of the second embodiment with a knurled belt lowered to a large extent.
Figure 12B:
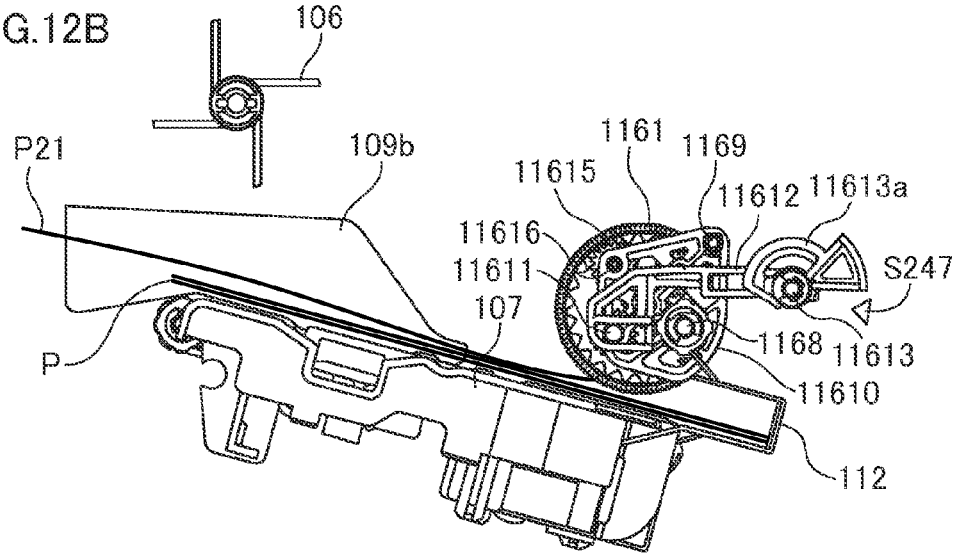
FIG. 12B is a schematic drawing illustrating the state of the knurled belt portion of the second embodiment with the knurled belt lowered to a medium extent.
Figure 12C:
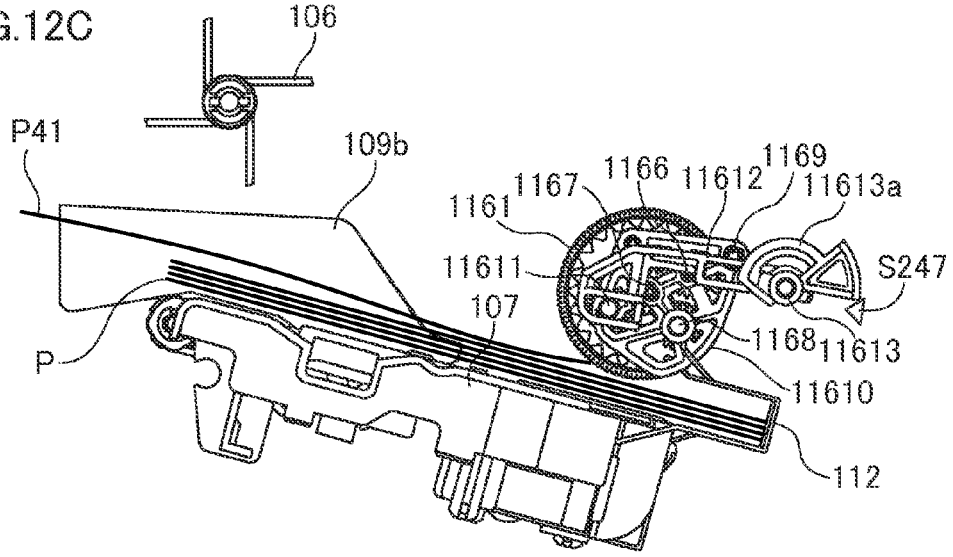
FIG. 12C is a schematic drawing illustrating the state of the knurled belt portion of the second embodiment with the knurled belt lowered to a small extent.
Figure 13A:
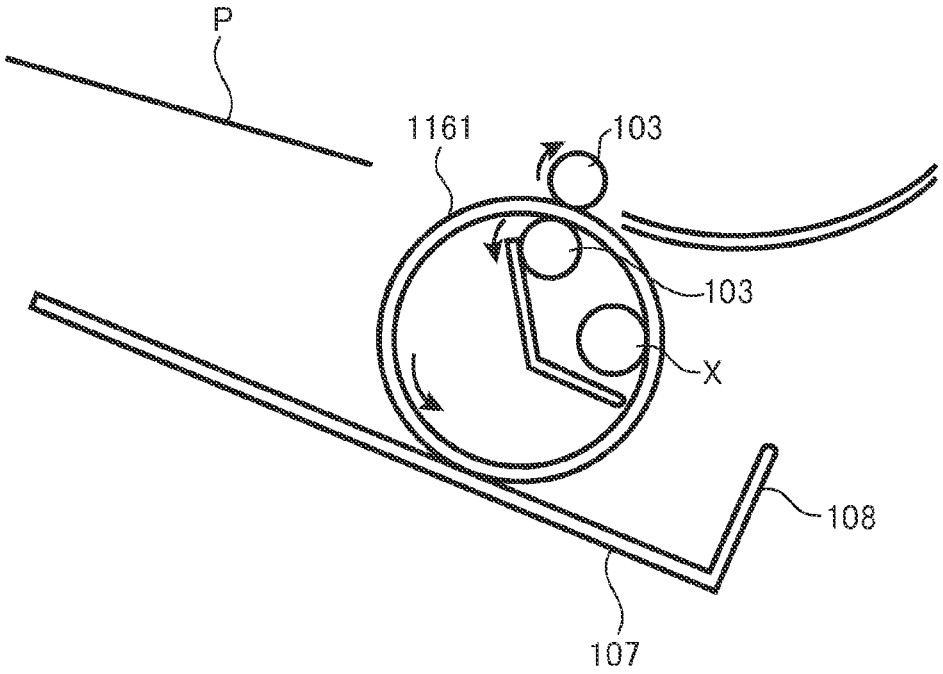
FIG.13A PRIOR ART
FIG. 13A is a schematic drawing illustrating a knurled belt of a sheet processing apparatus of the related art.
Figure 13B:
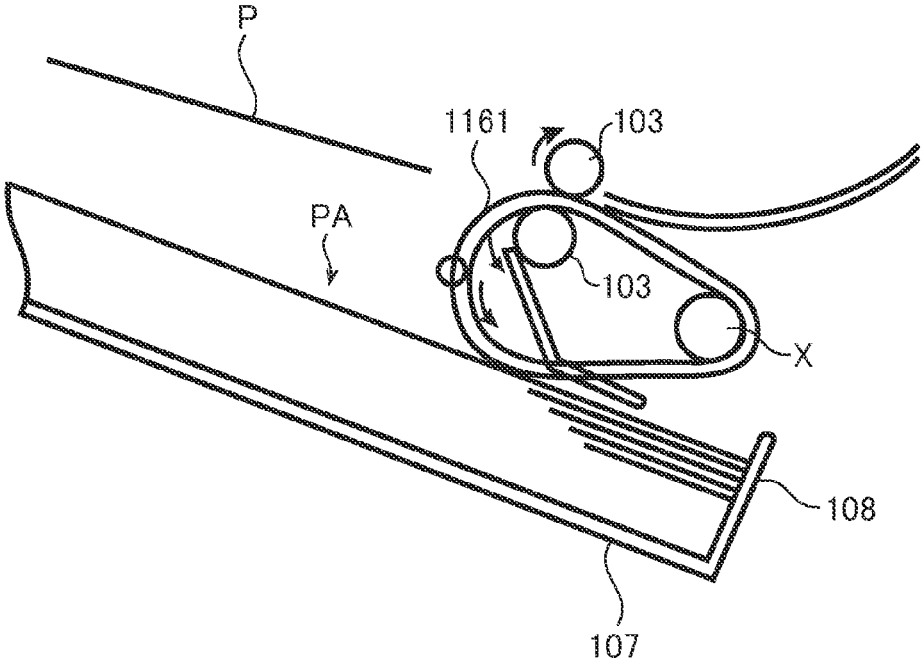
FIG.13B PRIOR ART
FIG. 13B is a schematic drawing illustrating a state in which the knurled belt illustrated in FIG. 13A is deformed.

FIGS. 12A to 12C are drawings illustrating the state of the knurled belt portion 116 when conveying the sheet P on the intermediate processing tray 107. FIG. 12A illustrates a state of conveying a first sheet P1. FIG. 12B illustrates a state of conveying a $21^{st}$ sheet P21 in a state in which 20 sheets of 64 $g/m^2$ are stacked on the intermediate processing tray. FIG. 12C illustrates a state of conveying a $41^{st}$ sheet P41 in a state in which 40 sheets of 64 $g/m^2$ are stacked on the intermediate processing tray.

In this embodiment as well, in the same manner as the first embodiment described above, the lowering amount of the knurled belts 1161 is controlled by driving the knurled motor M258 at the number of pulses according to the number of stacked sheets. Accordingly, as illustrated in FIG. 12A to 12C, when lowering the knurled belt 1161 according to the number of stacked sheets, the knurled belt 1161 can be lowered while maintaining the positional relationship at least between the first gear 1162 and the third gear 1164 constant. Consequently, even though the position of the knurled belt 1161 is changed according to the number of stacked sheets, the tensile force of the knurled belt 1161 may be maintained constant.

In the second embodiment, with the provision of a plurality of auxiliary gears 11614 and 11615, a circular shape of the knurled belt 1161 is prevented from being deformed or sagging significantly downward by distortion or the like at the time of rotating. Accordingly, the surface area that the knurled belts 1161 come into contact with the upper surface of the sheet is increased, so that the alignment of the sheet is prevented from being impaired by the load of the knurled belts 1161 at the time of alignment with the aligning plate 109.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-162893, filed Aug. 6, 2013, which is hereby incorporated by reference herein in its entirety.

What is claimed is:

1. A sheet processing apparatus comprising:

a sheet conveying portion configured to convey a sheet;

a sheet stacking portion on which the sheet conveyed by the sheet conveying portion is stacked;

an endless belt configured to convey the sheet by coming in contact with an upper surface of the sheet stacked on the sheet stacking portion;

an aligning portion configured to align a position of the sheet in a sheet conveying direction of the sheet by abutting against an end of the sheet conveyed by the endless belt;

a drive rotating member configured to rotate the endless belt while being in contact with the endless belt;

a shaft extending in a direction orthogonal to the sheet conveying direction;

a supporting portion configured to be swingable about the shaft, rotatably supporting the drive rotating member, and supporting the endless belt through the drive rotating member; and a lifting portion configured to raise and lower the endless belt by swinging the supporting portion.

2. The sheet processing apparatus according to claim 1, further comprising:

a drive portion configured to drive the lifting portion; and a control portion configured to control the drive portion such that the endless belt is positioned at a position corresponding to a number of sheets stacked on the sheet stacking portion.

3. The sheet processing apparatus according to claim 2, wherein the drive portion is a pulse motor.

4. The sheet processing apparatus according to claim 1, further comprising:

a shaft drive portion configured to drive the shaft; and a drive transmission portion configured to transmit the rotation of the shaft to the drive rotating member.

5. The sheet processing apparatus according to claim 4, wherein the drive transmission portion includes a first drive force transmitting rotating member provided on the shaft, and a second drive force transmitting rotating member rotatably supported on the supporting portion, and wherein the drive rotating member receives a transmission of rotation from the shaft through the first and second drive force transmitting rotating members.

6. The sheet processing apparatus according to claim 5, wherein the supporting portion rotatably supports the first and second drive force transmitting rotating members, and holds the drive rotating member, the first drive force transmitting rotating member, and the second drive force transmitting rotating member such that relative distances among the members are kept constant.

7. The sheet processing apparatus according to claim 6, wherein the first drive force transmitting rotating member is disposed to abut against an inner peripheral surface of the endless belt, and the drive rotating member and the first drive force transmitting rotating member are configured to rotate at the same velocity.

8. The sheet processing apparatus according to claim 1, further comprising a driven rotating member configured to nip the endless belt with the drive rotating member, the driven rotating member rotatably supported by the supporting portion.

9. The sheet processing apparatus according to claim 1, further comprising an auxiliary rotating member configured to abut against an inner peripheral surface of the endless belt, the auxiliary rotating member rotatably supported by the supporting portion.

10. The sheet processing apparatus according to claim 1, further comprising an auxiliary rotating member configured to abut against an inner peripheral surface of the endless belt, wherein the shaft is a rotation shaft of the auxiliary rotating member.

11. The sheet processing apparatus according to claim 1, wherein the shaft is provided inside the endless belt.

12. The sheet processing apparatus according to claim 1, wherein the endless belt conveys the sheet stacked on the sheet stacking portion by coming into contact with the upper surface of the sheet while being deflected.

13. An image forming apparatus comprising:

an image forming portion; and a sheet processing apparatus according to claim 1 configured to process a sheet on which an image is formed by the image forming portion.

14. A sheet processing apparatus comprising:

a sheet conveying portion configured to convey a sheet;

a sheet stacking portion on which the sheet conveyed by the sheet conveying portion is stacked;

an endless belt configured to convey the sheet by coming in contact with an upper surface of the sheet stacked in the sheet stacking portion;

an aligning portion configured to align a position of the sheet in a sheet conveying direction of the sheet by abutting against an end of the sheet conveyed by the endless belt;

a first rotating member contacting with an inner peripheral surface of the endless belt;

a second rotating member contacting with the outer surface of the endless belt, the second rotating member being configured to nip the endless belt with the first rotating member;

a third rotating member contacting with the inner peripheral surface of the endless belt; and a lifting unit configured to raise and lower the endless belt while keeping constant a distance between a rotation center of the first rotating member and a rotation center of the third rotating member.

15. The sheet processing apparatus according to claim 14, further comprising:

a drive portion configured to drive the lifting unit; and a control portion configure to control the drive portion such that the endless belt is positioned at a position corresponding to a number of sheets stacked on the sheet stacking portion.

16. The sheet processing apparatus according to claim 14, wherein the lifting unit comprises:

a swingable supporting portion, rotatably supporting the first rotating member, the second rotating member and the third rotating member, and supporting the endless belt through the first and second rotating members, and a lifting portion configured to raise and lower the endless belt by swinging the supporting portion.

17. The sheet processing apparatus according to claim 16, further comprising a shaft configured to swingably support the endless belt, wherein the endless belt has a circular shape, and a center of the shaft is deviated from a center of the endless belt.

18. The sheet processing apparatus according to claim 14, wherein the first rotating member is a gear engaging with teeth formed on the inner peripheral surface of the endless belt, and the third rotating member is a gear engaging with the teeth formed on the inner peripheral surface of the endless belt.

19. The sheet processing apparatus according to claim 14, wherein the endless belt rotates by receiving a driving force transmitted by the first rotating member.

20. The sheet processing apparatus according to claim 14, wherein the endless belt rotates and is supported through the first to third rotating member.

21. The sheet processing apparatus according to claim 14, wherein the endless belt has a circular shape, and the lifting unit raises and lowers the endless belt by swinging the endless belt about a swinging center which is deviated from a center of the endless belt.

* * * * *